US009051934B2

(12) United States Patent
Fraser

(10) Patent No.: US 9,051,934 B2
(45) Date of Patent: Jun. 9, 2015

(54) APPARATUS AND METHOD FOR OIL EQUALIZATION IN MULTIPLE-COMPRESSOR SYSTEMS

(71) Applicant: Bruce A. Fraser, Manlius, NY (US)

(72) Inventor: Bruce A. Fraser, Manlius, NY (US)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 0 days.

(21) Appl. No.: 14/190,268

(22) Filed: Feb. 26, 2014

(65) Prior Publication Data

US 2014/0241926 A1 Aug. 28, 2014

Related U.S. Application Data

(60) Provisional application No. 61/770,868, filed on Feb. 28, 2013.

(51) Int. Cl.
*F04C 29/02* (2006.01)
*F04C 23/00* (2006.01)

(52) U.S. Cl.
CPC ..... *F04C 29/021* (2013.01); *F04C 23/001* (2013.01); *F04C 23/008* (2013.01); *F04C 2240/806* (2013.01); *F04C 2240/809* (2013.01)

(58) Field of Classification Search
USPC ..... 418/55.1, 55.6; 184/6.16, 6.18, 6.28
See application file for complete search history.

(56) References Cited

U.S. PATENT DOCUMENTS

| | | | | |
|---|---|---|---|---|
| 3,360,958 | A | 1/1968 | Miner | |
| 4,729,228 | A | 3/1988 | Johnsen | |
| 6,428,296 | B1 * | 8/2002 | Elson et al. | 418/55.6 |
| 6,599,109 | B2 | 7/2003 | Zamudio et al. | |
| 6,736,607 | B2 | 5/2004 | Ginies et al. | |
| 7,316,291 | B2 | 1/2008 | Thomsen et al. | |
| 7,421,850 | B2 | 9/2008 | Street et al. | |
| 7,721,757 | B2 | 5/2010 | Ginies et al. | |
| 8,079,830 | B2 | 12/2011 | SÜss et al. | |
| 8,337,183 | B2 | 12/2012 | Milliff et al. | |
| 8,398,387 | B2 * | 3/2013 | Shiotani et al. | 418/55.6 |
| 2001/0026766 | A1 | 10/2001 | Terai et al. | |
| 2005/0229627 | A1 | 10/2005 | De Bernardi et al. | |
| 2006/0059929 | A1 | 3/2006 | Sakitani et al. | |

(Continued)

FOREIGN PATENT DOCUMENTS

| | | | |
|---|---|---|---|
| EP | 1 120 611 | A1 | 8/2001 |
| JP | 04287880 | A | 10/1992 |
| JP | 05071811 | A | 3/1993 |
| JP | H05272477 | A | 10/1993 |

(Continued)

*Primary Examiner* — Mary A Davis
(74) *Attorney, Agent, or Firm* — Reinhart Boerner Van Deuren P.C.

(57) ABSTRACT

A method of operating a refrigeration system, that includes providing a plurality of compressors connected in parallel. The plurality of compressors includes a plurality of scroll compressors. The method further includes returning circulated refrigerant to the plurality of compressors, the circulated refrigerant having oil entrained therein. Returning circulated refrigerant to the plurality of compressors includes returning more oil to one of the plurality of compressors than to another of the plurality of compressors. The method also includes supplying oil from one of the plurality of compressors to at least one other of the plurality of compressors. Supplying oil from one of the plurality of compressors includes supplying oil from the one of the plurality of compressors having an opening in its housing. A fitting is assembled into the opening. The fitting protrudes through the housing into an interior portion of the housing.

5 Claims, 10 Drawing Sheets

FIG. 6

(56) References Cited

U.S. PATENT DOCUMENTS

| | | | | |
|---|---|---|---|---|
| 2007/0074534 | A1 | 4/2007 | Sato | |
| 2009/0035168 | A1 | 2/2009 | Ginies et al. | |
| 2009/0041602 | A1 | 2/2009 | Ginies et al. | |
| 2009/0081062 | A1 | 3/2009 | Upadhye et al. | |
| 2010/0092319 | A1* | 4/2010 | Duppert | 418/55.6 |
| 2010/0186433 | A1 | 7/2010 | Galante et al. | |
| 2010/0186439 | A1 | 7/2010 | Ogata et al. | |
| 2012/0297818 | A1* | 11/2012 | Toyama et al. | 418/55.6 |
| 2014/0037483 | A1 | 2/2014 | Fraser et al. | |
| 2014/0037484 | A1 | 2/2014 | Fraser et al. | |
| 2014/0056725 | A1 | 2/2014 | Fraser et al. | |

FOREIGN PATENT DOCUMENTS

| | | | |
|---|---|---|---|
| JP | 07035045 | A | 2/1995 |
| JP | H0829018 | A | 2/1996 |
| JP | H0861809 | A | 3/1996 |
| JP | 08128764 | A | 5/1996 |
| JP | 2605498 | B2 | 4/1997 |
| JP | 2001132645 | A | 5/2001 |
| JP | 2005076515 | A | 3/2005 |
| KR | 1020050065258 | A | 6/2005 |
| WO | 97/16647 | A1 | 5/1997 |
| WO | 2005/103492 | A1 | 11/2005 |
| WO | 2008/081093 | A2 | 7/2008 |

* cited by examiner

APPARATUS AND METHOD FOR OIL EQUALIZATION IN MULTIPLE-COMPRESSOR SYSTEMS

CROSS-REFERENCE TO RELATED PATENT APPLICATIONS

This patent application claims the benefit of U.S. Provisional Patent Application No. 61/770,868, filed Feb. 28, 2013, the entire teachings and disclosure of which are incorporated herein by reference thereto.

FIELD OF THE INVENTION

This invention generally relates to multi-compressor refrigeration systems.

BACKGROUND OF THE INVENTION

A particular example of the state of the art with respect to suction gas distribution in a parallel compressor assembly is represented by WIPO patent publication WO2008/081093 (Device For Suction Gas Distribution In A Parallel Compressor Assembly, And Parallel Compressor Assembly), which shows a distribution device for suction gas in systems with two or more compressors, the teachings and disclosure of which is incorporated in its entirety herein by reference thereto. A particular example of oil management in systems having multiple compressors is disclosed in U.S. Pat. No. 4,729,228 (Suction Line Flow Stream Separator For Parallel Compressor Arrangements), the teachings and disclosure of which is incorporated in its entirety herein by reference thereto.

In a refrigeration system, when distributing oil from one compressor to another in multiple-compressor systems, the amount of oil distributed is dependent on the oil available to be drawn into the opening of an oil-supplying compressor such that the oil can then be distributed to one or more oil-receiving compressors in the refrigeration system. When oil is circulated and returned to the oil-supplying compressor, the oil may run down an interior surface of the oil-supplying compressor housing such that the oil is presented prematurely at the opening of the oil-supplying compressor. As a result, oil may be distributed to oil-receiving compressors when it should remain in the oil-supplying compressor. It would be desirable to have an apparatus and method to prevent these occurrences.

Embodiments of the invention provide such an apparatus and method. These and other advantages of the invention, as well as additional inventive features, will be apparent from the description of the invention provided herein.

BRIEF SUMMARY OF THE INVENTION

In a particular aspect, embodiments of the invention provide a scroll compressor that includes a housing having an inlet port and an outlet port. The housing has a sidewall with an internal surface surrounding an internal chamber with an oil sump at a bottom of the internal chamber. Scroll compressor bodies are located in the housing. The scroll compressor bodies have respective bases and respective scroll ribs that project from the respective bases, and which mutually engage. The scroll compressor bodies are operative to compress fluid entering from the inlet port and discharge compressed fluid toward the outlet port. A motor provides a rotational output operatively driving one of the scroll compressor bodies to facilitate relative movement for the compression of fluid. The scroll compressor further includes an oil equalization fitting mounted through the sidewall arranged below the inlet port to communicate oil to and from the oil sump. The oil equalization fitting includes an extension projecting inwardly from the internal surface and into the internal chamber.

In a particular embodiment, the aforementioned extension projects inwardly from the internal surface a sufficient distance so oil returning through the inlet port and down the sidewall substantially does not interfere with oil equalization. In more particular embodiments, the extension projects inwardly from the internal surface at least 2 millimeters. In some embodiments, the extension projects inwardly from the internal surface between 2 and 50 millimeters. The extension may be a unitary fitting body having a threaded head region and a tubular extension region, in which the threaded head region is mounted along an external surface of the housing, such that the tubular extension projects through a hole in the sidewall.

In certain embodiments, the extension extends through an outer portion of a lower bearing member. The lower bearing member supports a rotational shaft driven by the motor to drive the scroll compressor bodies. The lower bearing member may also include a hub supporting the rotational shaft, and at least one radial extension connecting the hub and the outer portion. The outer portion may be mounted and located in contact with the internal surface. In some embodiments, the outer portion includes a leg depending downward from the radial extension, such that an annular cavity is formed along a bottom side of the radial extension between the hub and the leg. The extension may be formed through the leg and adapted to communicate with oil that extends from the oil sump into the annular cavity.

In yet another aspect, embodiments of the invention provide a method of operating a refrigeration system that includes providing a plurality of compressors connected in parallel. The method further includes returning circulated refrigerant to the plurality of compressors, the circulated refrigerant having oil entrained therein. Returning circulated refrigerant to the plurality of compressors includes returning more oil to one of the plurality of compressors than to another of the plurality of compressors. The method also includes supplying oil from one of the plurality of compressors to at least one other of the plurality of compressors. Supplying oil from one of the plurality of compressors includes supplying oil from the one of the plurality of compressors having an opening in its housing. A fitting, positioned in the opening, is also provided. The fitting protrudes through the housing into an interior portion of the housing.

In one aspect, embodiments of the invention provide a method of operating a refrigeration system that includes providing a plurality of compressors connected in parallel. The plurality of compressors includes a lead compressor and one or more remaining compressors. The method further includes returning circulated refrigerant to the plurality of compressors, the circulated refrigerant having oil entrained therein. Returning circulated refrigerant to the plurality of compressors includes returning more oil to the lead compressor than to the one or more remaining compressors. The method also includes supplying oil from the lead compressor to at least one of the one or more remaining compressors. Supplying oil from the lead compressor includes supplying oil from the lead compressor having an opening in a housing of the compressor. A fitting, positioned in the opening, is also provided. The fitting protrudes through the housing into an interior portion of the housing.

In a particular embodiment, the method includes further comprising aligning an opening in the fitting with an opening in a lower bearing member. The method may further include supplying oil via an opening in the lower bearing member. Additionally, the method includes welding the fitting into the opening in the housing. In certain embodiments, the method includes connecting the fitting to an oil distribution line that connects respective oil sumps of each of the plurality of compressors.

In alternate embodiments, each of the plurality of compressors has a fitting inserted through an opening in its oil sump. The method may also include configuring the fitting to protrude far enough into the interior of the housing such that oil running down the interior surface of the housing does not flow into the opening.

In still another aspect, embodiments of the invention provide a refrigeration system that includes a plurality of compressors connected in parallel with each other, and a common supply line for supplying refrigerant and oil to each of the plurality of compressors. Each of the plurality of compressors has an opening in a lower portion of its compressor housing. Each opening is configured to accommodate a flow of oil to and from an oil sump for its respective compressor. At least one compressor of the plurality of compressors has a fitting inserted into its opening. The fitting protrudes into an interior space of the at least one compressor.

In one aspect, embodiments of the invention provide a refrigeration system that includes a plurality of compressors connected in parallel. The plurality of compressors includes a lead compressor and one or more remaining compressors. The refrigeration system may have a common supply line for supplying refrigerant and oil to each of the plurality of compressors. The common supply line is configured to return more oil to the lead compressor than to the one or more remaining compressors. Each of the plurality of compressors has an opening in a lower portion of its compressor housing. Each opening is configured to accommodate a flow of oil to and from an oil sump for its respective compressor. The lead compressor has a fitting inserted into its opening. The fitting protrudes into an interior space of the lead compressor.

In a particular embodiment, the fitting is coupled to an oil distribution line coupled to each opening of the one or more remaining compressors. In certain embodiments, the fitting has an opening aligned with an opening in a lower bearing member of the lead compressor. The opening in the fitting is arranged to accommodate a flow of oil from the oil sump out through the fitting. In certain embodiments, the fitting has a threaded opening configured to mate with a threaded portion of the oil distribution line. In alternate embodiments, the fitting is joined to the oil distribution line via brazing. The fitting is configured to protrude far enough into the interior of the housing such that oil running down the interior surface of the housing does not flow into the opening.

In still another aspect, embodiments of the invention provide a scroll compressor, that includes a housing having an inlet port and an outlet port. The housing has a sidewall with an internal surface surrounding an internal chamber with an oil sump at a bottom of the internal chamber. The scroll compressor further includes scroll compressor bodies in the housing. The scroll compressor bodies have respective bases and respective scroll ribs that project from the respective bases and which mutually engage. The scroll compressor bodies operate to compress fluid entering from the inlet port and discharge compressed fluid toward the outlet port. A motor provides a rotational output operatively driving one of the scroll compressor bodies to facilitate relative movement for the compression of fluid. An oil equalization fitting is mounted through the sidewall arranged below the inlet port to communicate oil to and from the oil sump. A deflector is positioned above the oil equalization fitting and attached to an interior surface of the housing. The deflector is configured to divert oil, on the interior surface, away from the oil equalization fitting. In a particular embodiment, the deflector is arch-shaped. In other embodiments, the deflector comprises at least one straight angled portion.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

The following detailed description describes embodiments of the invention as applied in a multi-compressor refrigeration system. However, one of ordinary skill in the art will recognize that the invention is not necessarily limited to refrigeration systems. Embodiments of the invention may also find use in other systems where multiple compressors are used to supply a flow of compressed gas.

Figure 1:
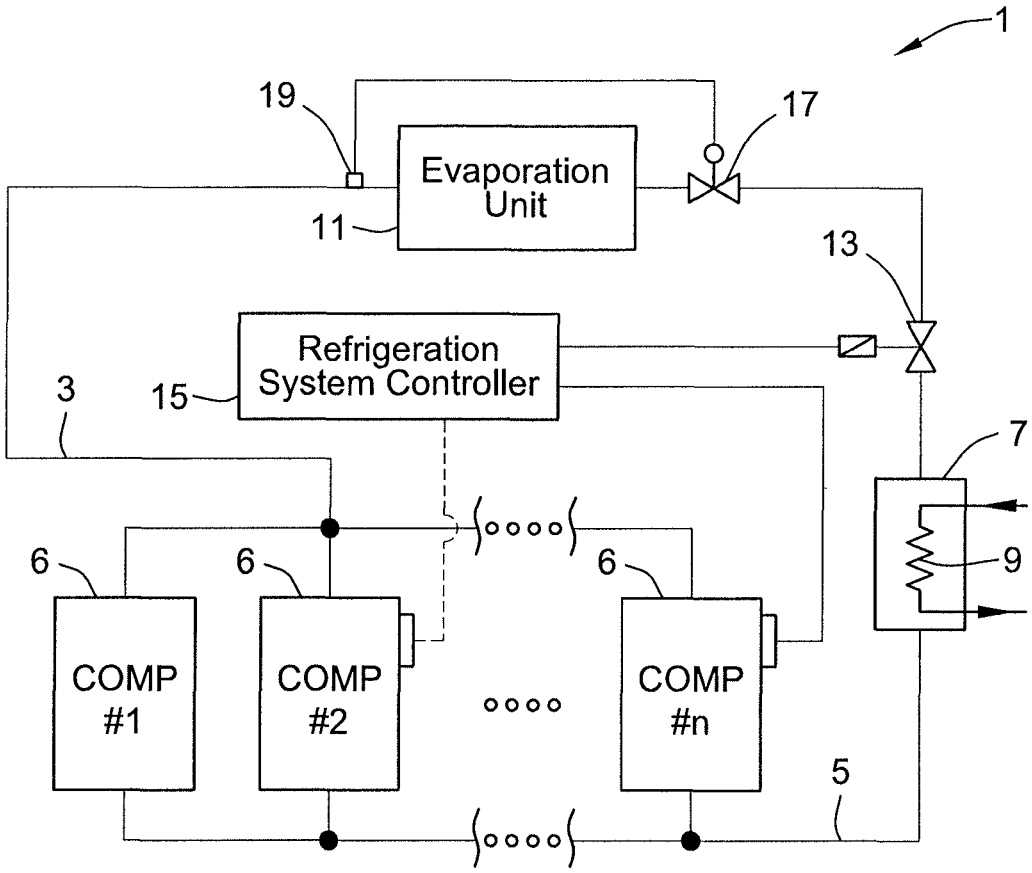
FIG. 1 is a block diagram of a multi-compressor refrigeration system, constructed in accordance with an embodiment of the invention.

FIG. 1 provides a schematic illustration of an exemplary multiple-compressor refrigeration system 1 having N compressors 6. The N compressors 6 of refrigeration system 1 are connected in a parallel circuit having inlet flow line 3 that supplies a flow of refrigerant to the N compressors 6, and outlet flow line 5 that carries compressed refrigerant away from the N compressors 6. In certain embodiments, the flow of refrigerant carries oil entrained within the flow, the oil used to lubricate moving parts of the compressor 6. As shown, the outlet flow line 5 supplies a condenser 7. In a particular embodiment, the condenser 7 includes a fluid flow heat exchanger 9 (e.g. air or a liquid coolant) which provides a flow across the condenser 7 to cool and thereby condense the compressed, high-pressure refrigerant.

An evaporation unit 11 to provide cooling is also arranged in fluid series downstream of the condenser 7. In an alternate embodiment, the condenser 7 may feed multiple evaporation units arranged in parallel. In the embodiment of FIG. 1, the evaporation unit 11 includes a shut off liquid valve 13, which, in some embodiments, is controlled by the refrigeration system controller 15 to allow for operation of the evaporation unit 11 to produce cooling when necessitated by a demand load on the refrigeration system 1, or to preclude operation of the evaporation unit 11 when there is no such demand. The refrigeration system controller 15 may also be directly connected to one or more of the N compressors 6. The evaporation unit 11 also includes an expansion valve 17 that may be responsive to, or in part controlled by, a downstream pressure of the evaporation unit 11, sensed at location 19. The expansion valve 17 is configured to control the discharge of refrigerant into the evaporation unit 11, wherein due to the evaporation, heat is absorbed to evaporate the refrigerant to a gaseous state thereby creating a cooling/refrigeration effect at the evaporation unit 11. The evaporation unit 11 returns the expanded refrigerant in a gaseous state along the inlet flow line 3 to the bank of N compressors 6.

It should be noted that, for the sake of convenience, embodiments of the invention are frequently described hereinbelow with respect to their application in systems having multiple scroll compressors for compressing refrigerant. While particular advantages and configurations are shown for scroll compressor, some of these embodiments are not limited to scroll compressors, but may find use in a variety of compressors other than scroll compressors.

Figure 2:
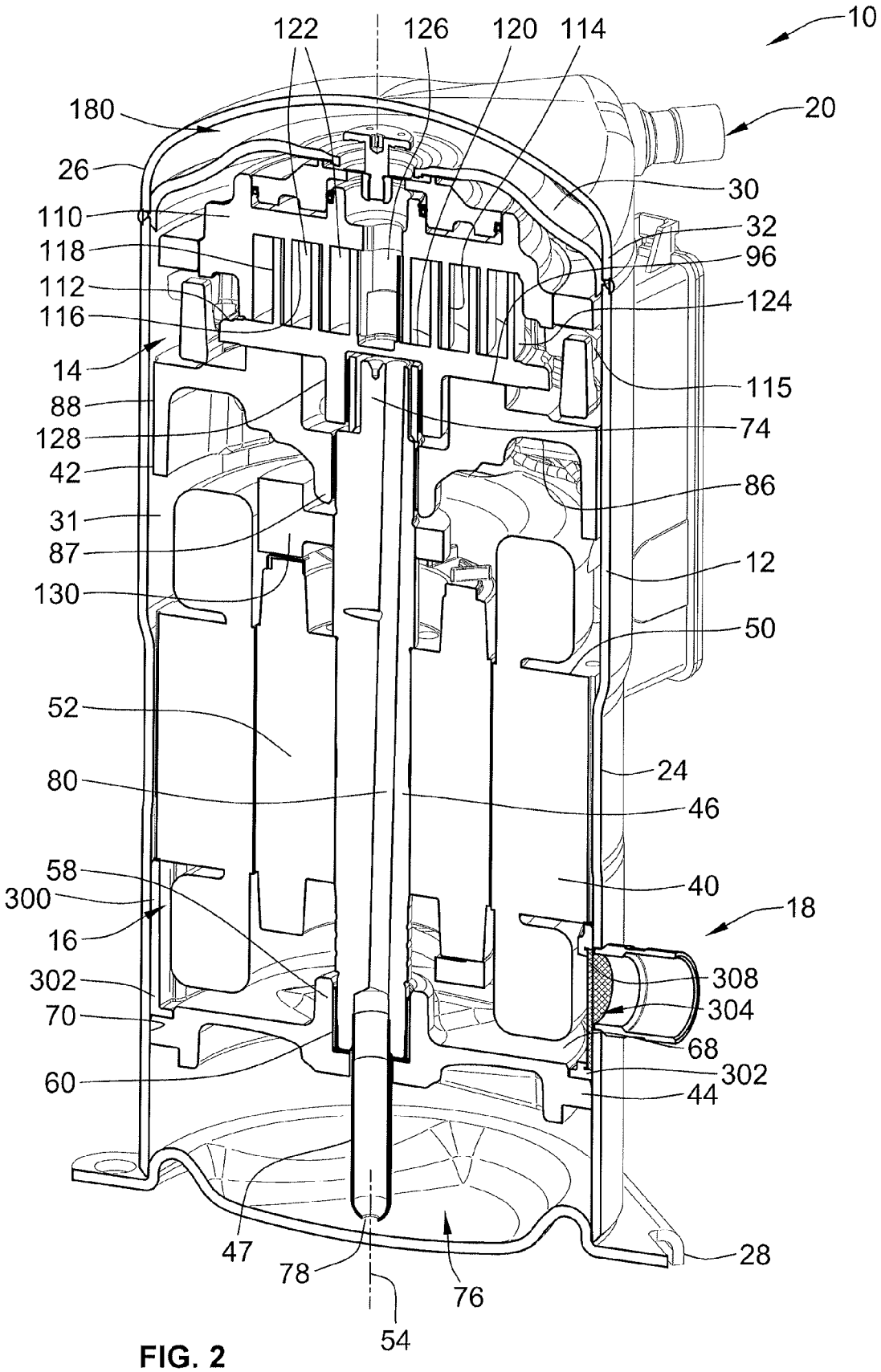
FIG. 2 is a cross-sectional view of a scroll compressor, constructed in accordance with an embodiment of the invention.

An embodiment of the present invention is illustrated in FIG. 2, which illustrates a cross-sectional view of a compressor assembly 10 generally including an outer housing 12 in which a compressor apparatus 14 can be driven by a drive unit 16. In the exemplary embodiments described below, the compressor apparatus 14 is a scroll compressor. Thus, the terms compressor apparatus and scroll compressor are, at times, used interchangeably herein. The compressor assembly 10 may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The compressor assembly 10 is operable through operation of the drive unit 16 to operate the compressor apparatus 14 and thereby compress an appropriate refrigerant or other fluid that enters the refrigerant inlet port 18 and exits the refrigerant outlet port 20 in a compressed high pressure state.

The outer housing 12 may take various forms. In a particular embodiment, the outer housing 12 includes multiple housing or shell sections, and, in certain embodiments, the outer housing 12 has three shell sections that include a central housing section 24, a top end housing section 26 and a bottom end housing section, or base plate 28. In particular embodiments, the housing sections 24, 26, 28 are formed of appropriate sheet steel and welded together to make a permanent outer housing 12 enclosure. However, if disassembly of the outer housing 12 is desired, methods for attaching the housing sections 24, 26, 28 other than welding may be employed including, but not limited to, brazing, use of threaded fasteners or other suitable mechanical means for attaching sections of the outer housing 12.

The central housing section 24 is preferably tubular or cylindrical and may abut or telescopically fit with the top and bottom end housing sections 26, 28. As can be seen in the embodiments of FIG. 2, a separator plate 30 is disposed in the top end housing section 26. During assembly, these components can be assembled such that, when the top end housing section 26 is joined to the central cylindrical housing section 24, a single weld around the circumference of the outer housing 12 joins the top end housing section 26, the separator plate 30, and the central cylindrical housing section 24. While the top end housing section 26 is generally dome-shaped and includes a cylindrical side wall region 32 to mate with the center housing section 24 and provide for closing off the top end of the outer housing 12, in particular embodiments, the bottom end housing section may be dome-shaped, cup-shaped, or substantially flat. As shown in FIG. 2, assembly of the outer housing 12 results in the formation of an enclosed chamber 31 that surrounds the drive unit 16, and partially surrounds the compressor apparatus 14.

In an exemplary embodiment of the invention in which a scroll compressor 14 is disposed within the outer housing 12, the scroll compressor 14 includes first and second scroll compressor bodies which preferably include a stationary fixed scroll compressor body 110 and a movable scroll compressor body 112. While the term "fixed" generally means stationary or immovable in the context of this application, more specifically "fixed" refers to the non-orbiting, non-driven scroll member, as it is acknowledged that some limited range of axial, radial, and rotational movement is possible due to thermal expansion and/or design tolerances.

The movable scroll compressor body 112 is arranged for orbital movement relative to the fixed scroll compressor body 110 for the purpose of compressing refrigerant. The fixed scroll compressor body includes a first rib 114 projecting axially from a plate-like base 116 which is typically arranged in the form of a spiral. Similarly, the movable scroll compressor body 112 includes a second scroll rib 118 projecting axially from a plate-like base 120 and is in the shape of a similar spiral. The scroll ribs 114, 118 engage with one another and abut sealingly on the respective surfaces of bases 120, 116 of the respectively other compressor body 112, 110.

As shown in FIG. 2, the upper bearing member 42 includes a central bearing hub 87 into which the drive shaft 46 is journaled for rotation. Hereinafter, the upper bearing member 42 is also referred to as a "crankcase". The upper bearing member 42 also provides axial thrust support to the movable scroll compressor body 112 through a bearing support via an axial thrust surface 96. Extending outward from the central bearing hub 87 is a disk-like portion 86 that terminates in an intermittent perimeter support surface 88. In certain embodiments, the central bearing hub 87 extends below the disk-like portion 86, and the intermittent perimeter support surface 88 is adapted to have an interference and press-fit with the outer housing 12.

In a particular embodiment of the invention, the drive unit 16 in is the form of an electrical motor assembly 40. The electrical motor assembly 40 operably rotates and drives a shaft 46. Further, the electrical motor assembly 40 generally includes a stator 50 comprising electrical coils and a rotor 52 that is coupled to the drive shaft 46 for rotation together. The stator 50 is supported by the outer housing 12, either directly or via an adapter. The stator 50 may be press-fit directly into outer housing 12, or may be fitted with an adapter (not shown) and press-fit into the outer housing 12. In a particular embodiment, the rotor 52 is mounted on the drive shaft 46, which is supported by upper and lower bearing members 42, 44.

Energizing the stator 50 is operative to rotatably drive the rotor 52 and thereby rotate the drive shaft 46 about a central axis 54. Applicant notes that when the terms "axial" and "radial" are used herein to describe features of components or assemblies, they are defined with respect to the central axis 54. Specifically, the term "axial" or "axially-extending" refers to a feature that projects or extends in a direction along, or parallel to, the central axis 54, while the terms "radial' or "radially-extending" indicates a feature that projects or extends in a direction perpendicular to the central axis 54.

In particular embodiments, the lower bearing member 44 includes a central, generally cylindrical hub 58 that includes a central bushing and opening to provide a cylindrical bearing 60 to which the drive shaft 46 is journaled for rotational support. A plate-like ledge region 68 of the lower bearing member 44 projects radially outward from the central hub 58, and serves to separate a lower portion of the stator 50 from an oil lubricant sump 76. An axially-extending perimeter surface 70 of the lower bearing member 44 may engage with the inner diameter surface of the central housing section 24 to centrally locate the lower bearing member 44 and thereby maintain its position relative to the central axis 54. This can be by way of an interference and press-fit support arrangement between the lower bearing member 44 and the outer housing 12.

As can be seen in the embodiment of FIG. 2, the drive shaft 46 includes an impeller tube 47 attached at the bottom end of the drive shaft 46. In a particular embodiment, the impeller tube 47 is of a smaller diameter than the drive shaft 46, and is aligned concentrically with the central axis 54. The drive shaft 46 and impeller tube 47 pass through an opening in the cylindrical hub 58 of the lower bearing member 44. The impeller tube 47 has an oil lubricant passage and inlet port 78 formed at the end of the impeller tube 47.

At its upper end, the drive shaft 46 is journaled for rotation within the upper bearing member 42. In particular embodiments, the drive shaft 46 further includes an offset eccentric drive section 74 which typically has a cylindrical drive surface about an offset axis that is offset relative to the central axis 54. This offset drive section 74 may be journaled within a central hub 128 of the movable scroll compressor body 112 of the scroll compressor 14 to drive the movable scroll compressor body 112 about an orbital path when the drive shaft 46 rotates about the central axis 54. The eccentric offset drive section 74 engages the cylindrical bushing drive hub 128 in order to move the movable scroll compressor body 112 about an orbital path about the central axis 54 during rotation of the drive shaft 46 about the central axis 54.

Considering that this offset relationship causes a weight imbalance relative to the central axis 54, the assembly typically includes a counterweight 130 that is mounted at a fixed angular orientation to the drive shaft 46. The counterweight 130 acts to offset the weight imbalance caused by the eccentric offset drive section 74 and the movable scroll compressor body 112 that is driven about the orbital path. To provide for lubrication of all of the various bearing surfaces, the outer housing 12 provides the oil lubricant sump 76 at the bottom end of the outer housing 12 in which a suitable amount of oil lubricant may be stored. To guide the orbital movement of the movable scroll compressor body 112 relative to the fixed scroll compressor body 110, a key coupling may be provided. The key coupling may engage one or more slots 115 to prevent rotation of the key coupling.

It can also be seen that FIG. 2 shows an embodiment of a suction duct 300 in use in scroll compressor assembly 10. In certain embodiments, the suction duct 300 comprises a plastic molded ring body 302 that is situated in a flow path through the refrigerant inlet port 18 and in surrounding relation of the motor 40. The suction duct 300 is arranged to direct and guide refrigerant into the motor cavity for cooling the motor 40 while at the same time filtering out contaminants and directing lubricating oil around the periphery of the suction duct 300 to the oil sump 76.

Additionally, in particular embodiments, the suction duct 300 includes a screen 308 in the opening 304 that filters refrigerant gas as it enters the compressor through the inlet port 18, as illustrated in FIG. 2. The screen 308 is typically made of metal wire mesh, such as a stainless steel mesh, in which the individual pore size of the screen 308 typically ranges from 0.5 to 1.5 millimeters.

As shown in FIG. 2 and as mentioned above, the suction duct 300 is positioned in surrounding relation to the motor 40, and, in some embodiments, includes a generally arcuate outer surface that is in surface to surface contact with the inner surface of the generally cylindrical outer housing 12. In particular embodiments, the suction duct 300 includes a sealing face 316 (shown in FIG. 3) that forms a substantial seal between the outer housing 12 and the suction duct 300. The sealing face 316 can surround and seal the opening 304 to ensure that refrigerant flows into the motor cavity. The seal may be air tight, but is not required to be. This typically will ensure that more than 90% of refrigerant gas passes through the screen 308 and preferably at least 99% of refrigerant gas. By having a seal between the sealing face 316 and the portion of the outer housing 12 surrounding the inlet port 18, the suction duct 300 can filter large particles from the refrigerant gas that enters through the inlet port 18, thus preventing unfiltered refrigerant gas from penetrating into the compressor, and can direct the cooling refrigerant into the motor cavity for better cooling of the motor 40 while directing oil entrained in the flow of refrigerant down to oil sump 76.

During operation, the refrigerant gas flowing into the inlet port 18 is cooler than compressed refrigerant gas at the outlet port 20. Further, during operation of the scroll compressor 14, the temperature of the motor 40 will rise. Therefore, it is desirable to cool the motor 40 during operation of the compressor. To accomplish this, cool refrigerant gas that is drawn into the compressor outer housing 12 via inlet port 18 flows upward through and along the motor 40 in order to reach the scroll compressor 14, thereby cooling the motor 40.

Furthermore, the impeller tube 47 and inlet port 78 act as an oil pump when the drive shaft 46 is rotated, and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 has various radial passages projecting therefrom to feed oil through centrifugal force to appropriate bearing surfaces and thereby lubricate sliding surfaces as may be required.

Figure 3:
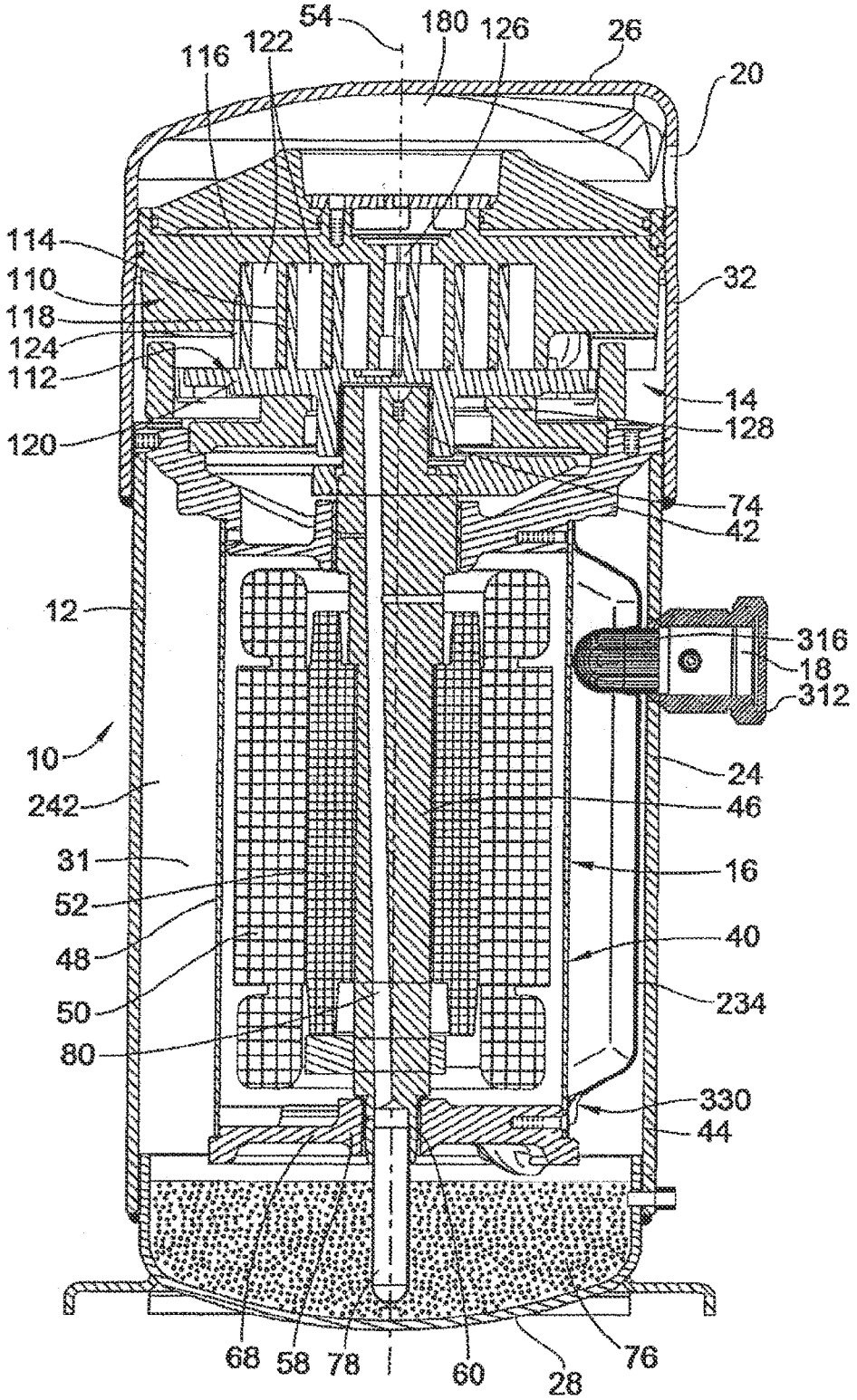
FIG. 3 (PRIOR ART)
FIG. 3 is a cross-sectional view of a scroll compressor, constructed in accordance with an alternate embodiment of the invention.
Figure 4:
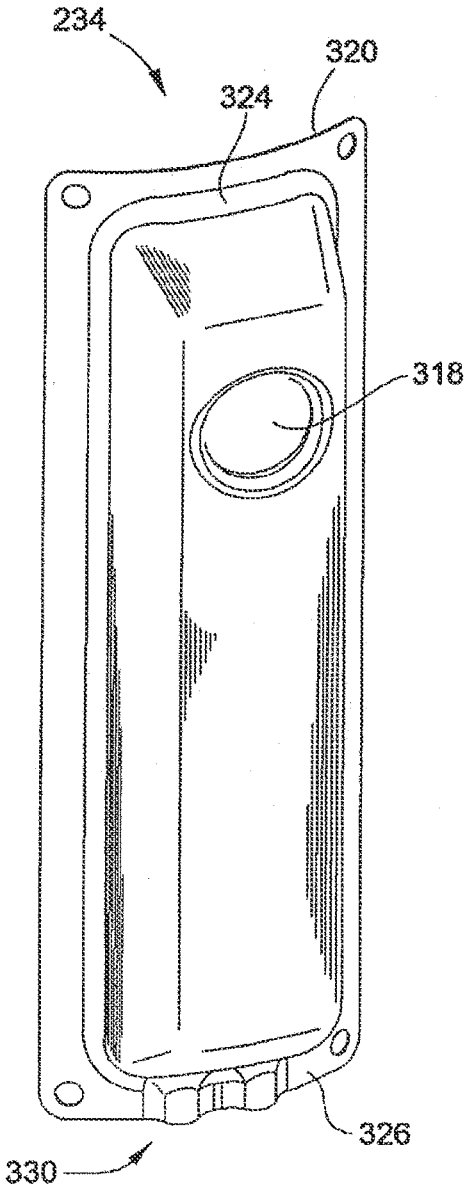
FIG. 4 (PRIOR ART)
FIG. 4 is a perspective front view of a suction duct, constructed in accordance with an embodiment of the invention.
Figure 5:
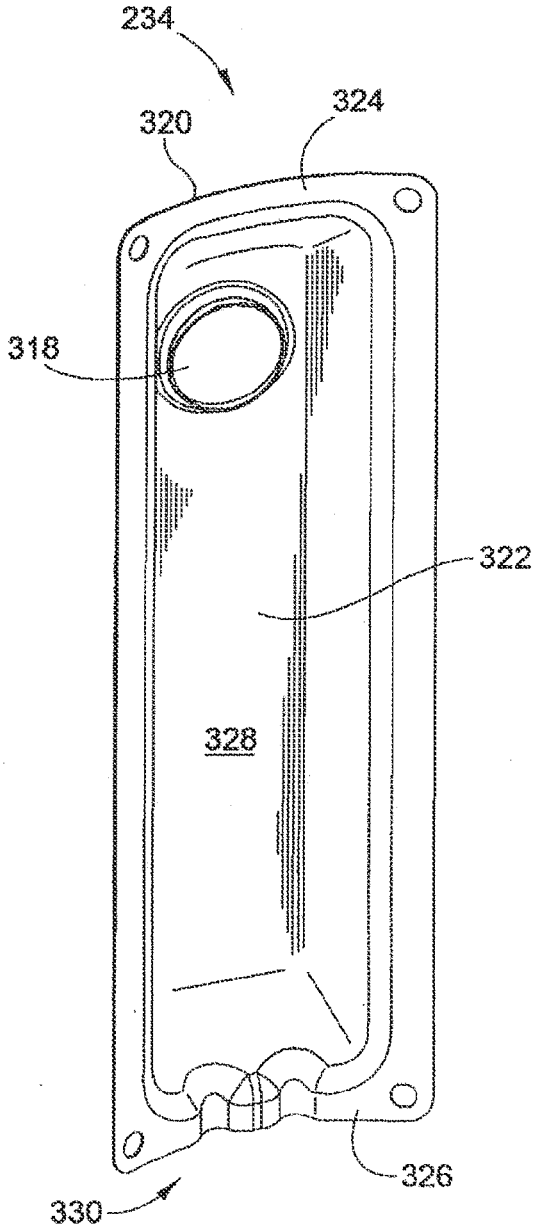
FIG. 5 (PRIOR ART)
FIG. 5 is a perspective rear view of the suction duct of FIG. 4.

FIG. 3 illustrates a cross-sectional view of an alternate embodiment of a compressor assembly 10. In FIG. 3, it can be seen that a suction duct 234 may be employed to direct incoming fluid flow (e.g. refrigerant) through the housing inlet port 18. To provide for the inlet port 18, the outer housing 12 includes an inlet opening in which resides an inlet fitting 312. In a particular embodiment shown in FIGS. 4 and 5, the suction duct 234 comprises a stamped sheet steel metal body having a constant wall thickness with an outer generally rectangular and arcuate mounting flange 320 which surrounds a duct channel 322 that extends between a top end 324 and a bottom end 326. The entrance opening and port 318 is formed through a channel bottom 328 proximate the top end 324. This opening and port 318 provide means for communicating and receiving fluid from the inlet port 18 via a sealing face 316 (shown in FIG. 3) which is received through the outer housing wall of the compressor and into duct channel 322 of the suction duct 234.

A duct channel provides a fluid flow path to a drain port 330 at or near the bottom end 326 of the suction duct 234. In this embodiment, the drain port 330 extends through the bottom end 326 and thereby provides a port for draining lubricant oil into the lubricant oil sump 76, and also to communicate substantially the entire flow of refrigerant for compression to a location just upstream of the motor housing.

Not only does the suction duct 234 direct refrigerant and substantially the entire flow of refrigerant from the inlet port 18 to a location upstream of the motor 40 and to direct fluid flow through the motor 40, but it also acts as a gravitational drain preferably by being at the absolute gravitational bottom of the suction duct 234 or proximate thereto so as to drain lubricant received in the suction duct 234 into the lubricant oil sump 76. This can be advantageous for several reasons. First, when it is desirable to fill the lubricant oil sump 76 either at initial charting or otherwise, oil can readily be added through the inlet port 18, which acts also as an oil fill port so that oil will naturally drain through the suction duct 234 and into the oil sump 76 through the drain port 330. The outer housing 12 can thereby be free of a separate oil port. Additionally, the surfaces of the suction duct 234 and redirection of oil therein causes coalescing of oil lubricant mist, which can then collect within the duct channel 322 and drain through the drain port 330 back into the oil sump 76. Thus, direction of refrigerant as well as direction of lubricant oil is achieved with the suction duct 234.

During operation, the scroll compressor assemblies 10 are operable to receive low pressure refrigerant at the housing inlet port 18 and compress the refrigerant for delivery to a high pressure chamber 180 where it can be output through the housing outlet port 20. As is shown, in FIGS. 2 and 3, the suction duct 234, 300 may be disposed internally of the outer housing 12 to guide the lower pressure refrigerant from the inlet port 18 into outer housing 12 and beneath the motor housing. This allows the low-pressure refrigerant to flow through and across the motor 40, and thereby cool and carry heat away from the motor 40. Low-pressure refrigerant can then pass longitudinally through the motor housing and around through void spaces therein toward the top end of the where it can exit through a plurality of motor housing outlets in the motor housing 48 (shown in FIG. 3), or in the upper bearing member 42. Upon exiting the motor housing outlet, the low-pressure refrigerant enters an annular chamber 242 (shown in FIG. 3) formed between the motor housing 48 and the outer housing 12. From there, the low-pressure refrigerant can pass by or through the upper bearing member 42.

Upon passing through the upper bearing member 42, the low pressure refrigerant finally enters an intake area 124 of the scroll compressor bodies 110, 112. From the intake area 124, the lower pressure refrigerant is progressively compressed through chambers 122 to where it reaches its maximum compressed state at a compression outlet 126 where it subsequently passes through a check valve and into the high pressure chamber 180. From there, high-pressure compressed refrigerant may then pass from the scroll compressor assembly 10 through the outlet port 20.

Figure 6:
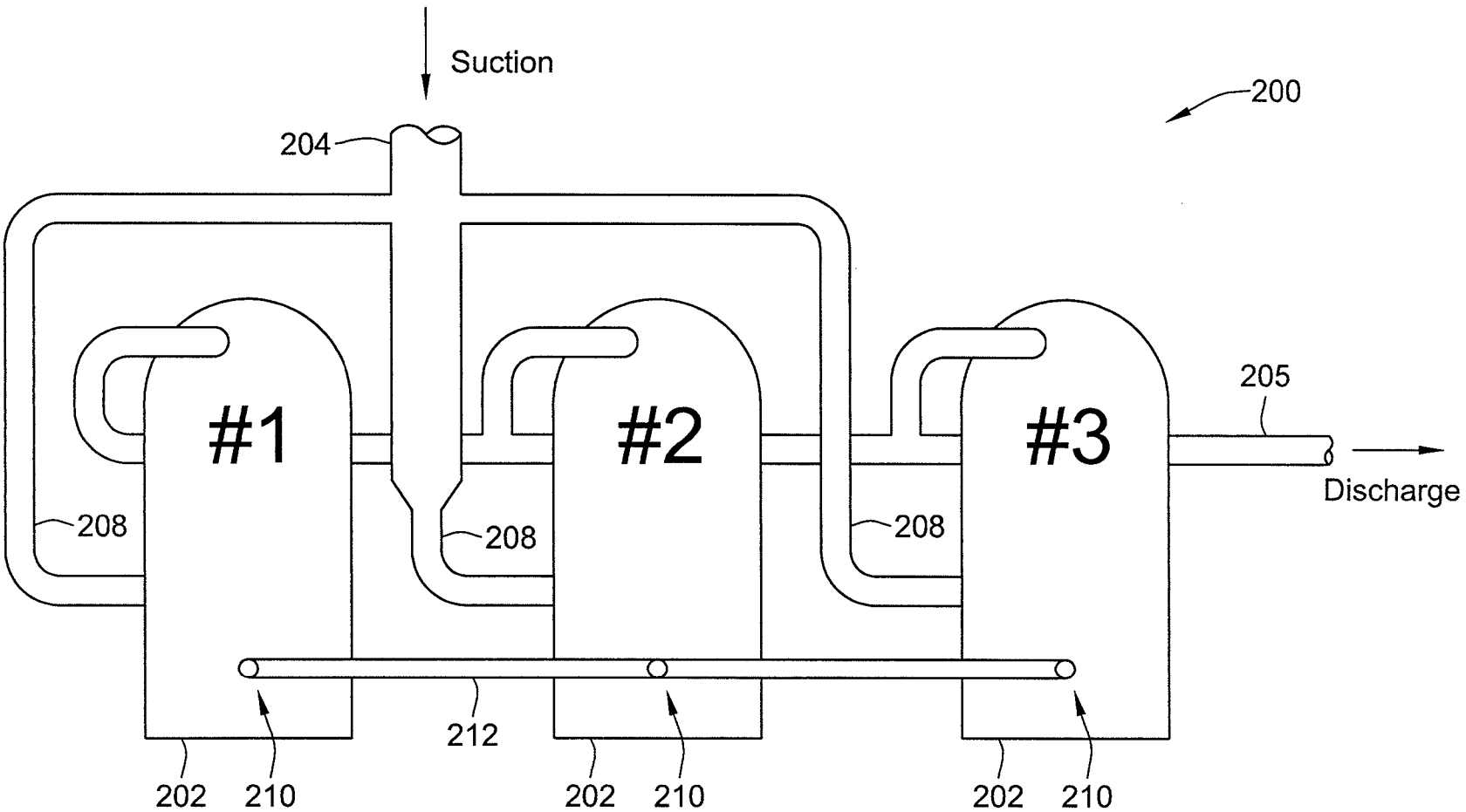
FIG. 6 is a schematic diagram of a multiple-compressor refrigeration system, constructed in accordance with an embodiment of the invention.
Figure 7:
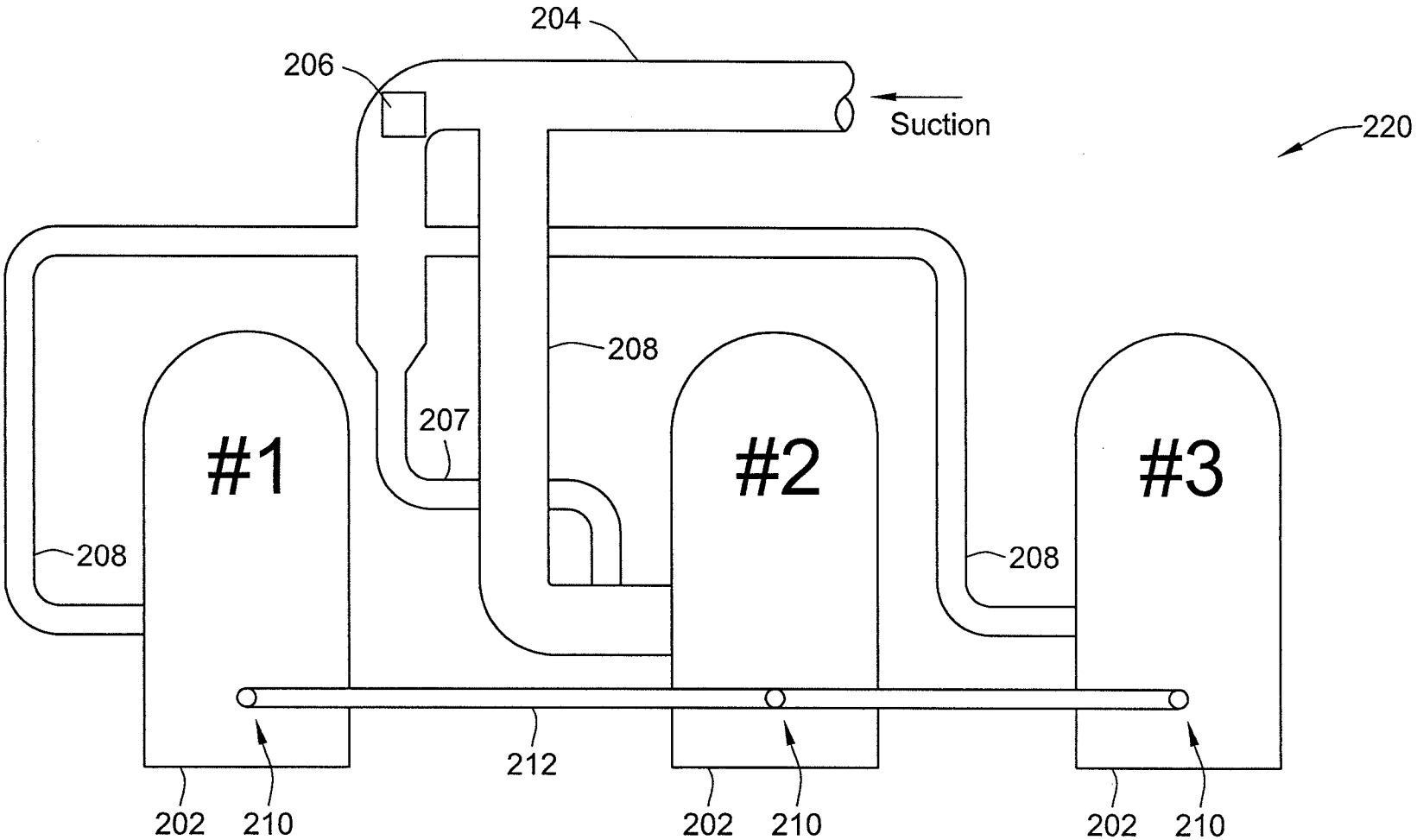
FIG. 7 is a schematic diagram of a multiple-compressor refrigeration system, constructed in accordance with an alternate embodiment of the invention.

FIGS. 6 and 7 are schematic diagrams showing two embodiments of multiple-compressor refrigeration systems 200, 220, such as the one shown in FIG. 1. In the refrigeration system 200 of FIG. 6, compressors #1, #2, and #3 202 are connected in parallel. In a particular embodiment of the invention, the compressors 202 are scroll compressors, similar or identical to those shown in FIGS. 2 and 3. However, in alternate embodiments, compressors other than scroll compressors may be used. Further, the embodiment of FIG. 6 shows the refrigeration system 200 having three compressors 202, though alternate embodiments of the invention may have fewer or greater than three compressors.

With respect to compressors #1, #2, and #3 202, the internal flow of refrigerant through the compressors 202 with their isolated oil sumps 76 configuration creates a pressure drop from the suction inlet port 18 to the oil sump 76 in each of the compressors that are running, due to the restriction of the gas flow. When any of these compressors 202 is shut off and there is no flow restriction, the oil sump 76 pressure will be relatively higher than a running compressor with the same suction inlet pressure. This pressure differential between the oil sump 76 of a running compressor and the oil sump 76 of an off compressor allows for oil distribution from the off compressor to the running compressors in the refrigeration system 200, 220.

In the arrangements shown in FIGS. 6 and 7, compressor #2 202 is the lead compressor. While all three compressors 202 receive a flow of refrigerant from a common supply line 204 and discharge refrigerant to a common discharge or outlet line 205 (shown in FIG. 6 only), the common supply line 204 is configured to deliver more lubricating oil to the lead compressor #2 202 than to the non-lead compressors #1 and #3 202, referred to herein as the remaining compressors #1 and #3 202. In certain embodiments, this is accomplished by restricting inlet supply lines 208 leading from the common supply line 204 to the remaining compressors #1 and #3 202, thereby restricting the flow of refrigerant and oil to these compressors 202. However, as shown in FIG. 7, this may also be accomplished by providing an oil separator 206, which separates out oil from the flow of refrigerant and delivers most of the oil to the lead compressor #2 202 via an oil drain 207. Still, other methods of returning more oil to the lead compressor #2 202 may be used, including different piping configurations, and various types of oil separator devices that return oil directly to the oil sump 76 of the lead compressor #2 202. As referenced above, the suction piping may include a restriction which serves to create a slightly reduced pressure at the suction inlet 18 of compressors #1 and #3 202.

Figure 8:
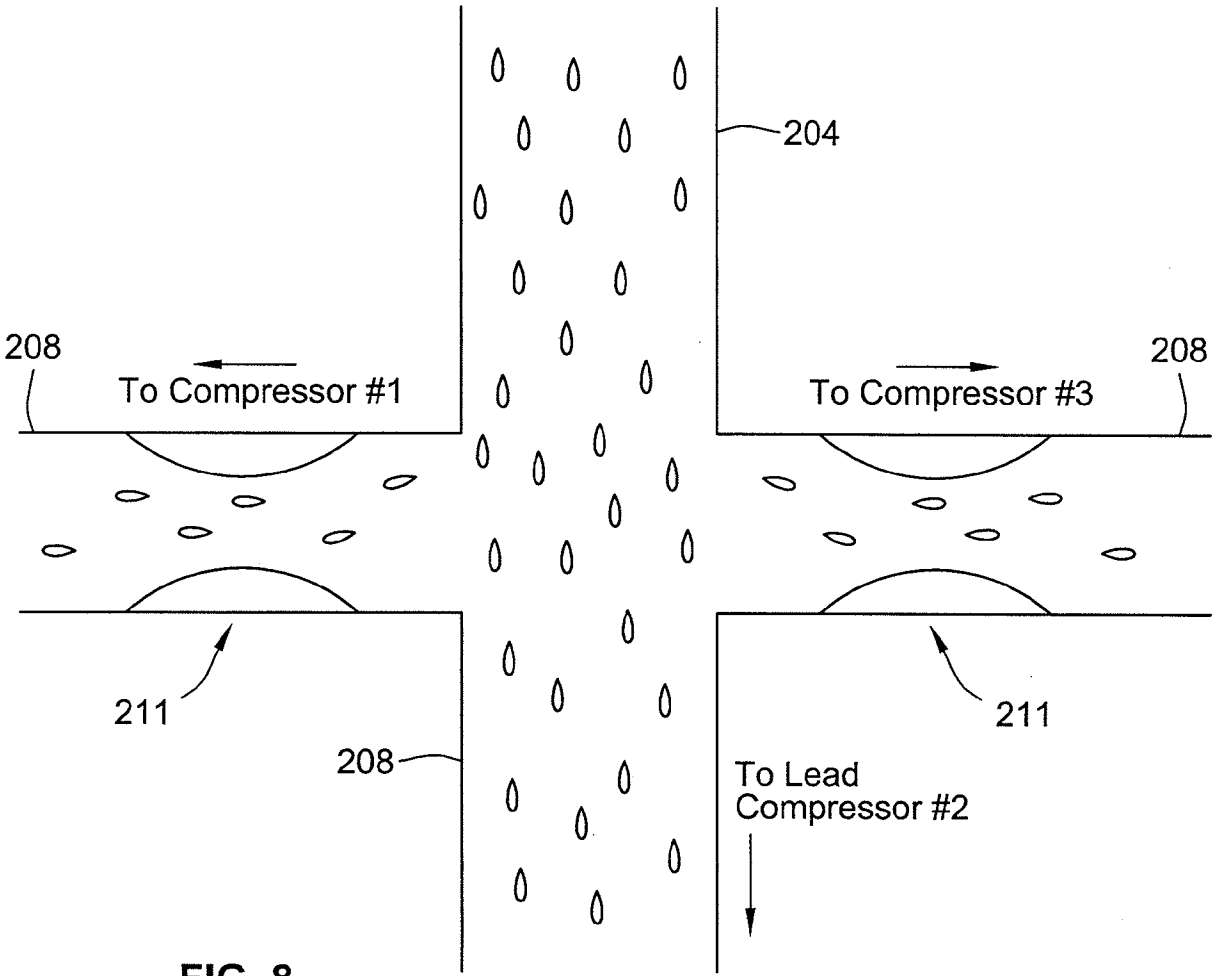
FIG. 8 is a schematic diagram of the common supply line, according to an embodiment of the invention.
Figure 9:
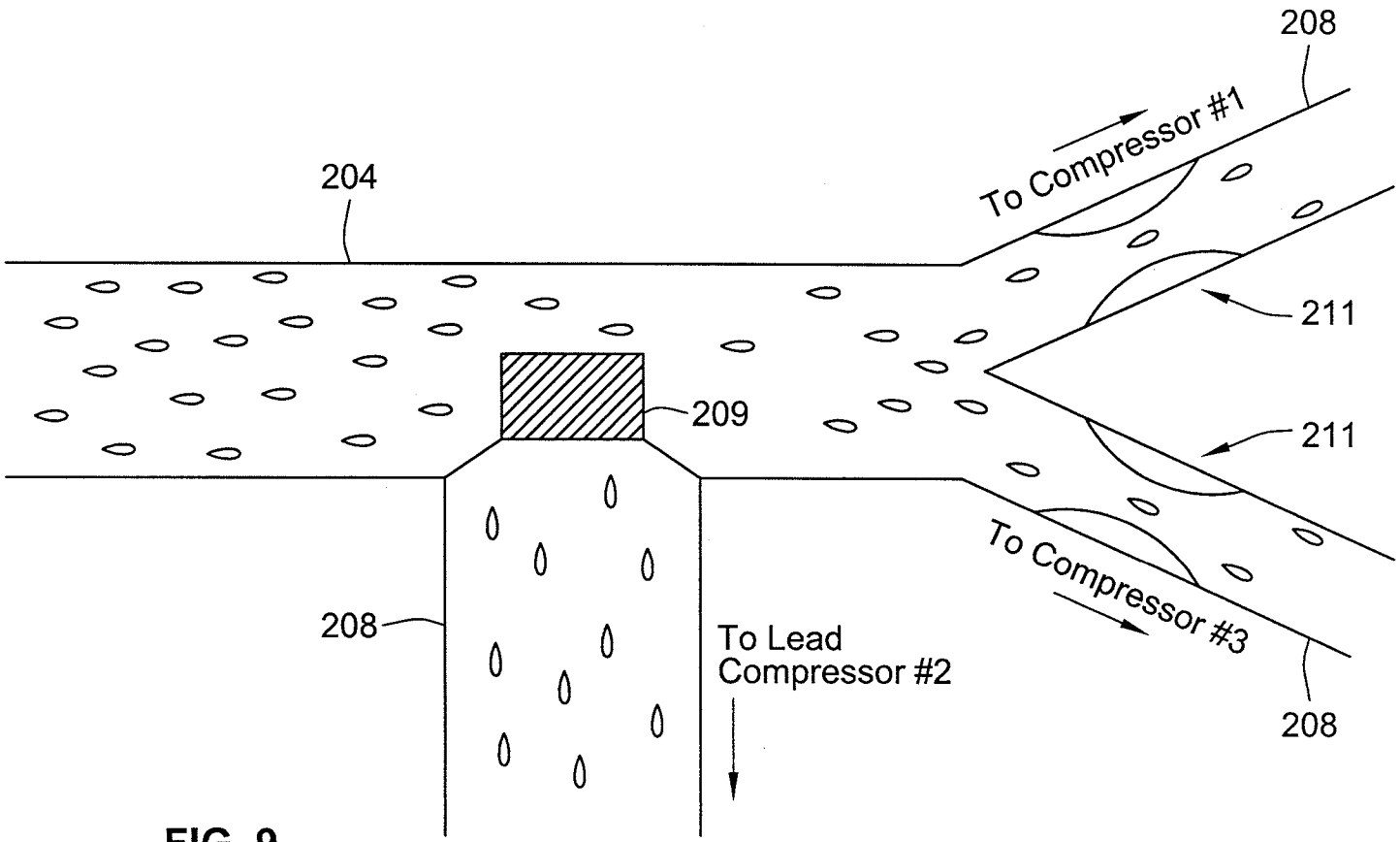
FIG. 9 is a schematic diagram of a common supply line with an oil separator, according to an embodiment of the invention.

FIGS. 8 and 9 are schematic diagrams illustrating exemplary piping configurations. As can be seen in FIG. 8, the inlet supply line 208 leading to the lead compressor #2 202 is larger than the inlet supply lines 208 that lead to the remaining, non-lead compressors #1, #3 202. Further, the inlet supply line 208 leading to the lead compressor #2 202 is aligned with the common supply line 204, whereas the inlet supply lines 208 to the remaining, non-lead compressors #1, #3 202 are angled at approximately 90 degrees to the common supply line 204. This configuration will result in more of the oil entrained in the flow of refrigerant flowing to the lead compressor #2 202. Moreover, the flow of oil to the remaining, non-lead compressors #1, #3 202 is further reduced by restrictions 211 placed in the inlet supply lines 208 to the remaining, non-lead compressors #1, #3 202. These restrictions 211 serve to reduce the suction pressure at the inlets of the remaining compressors #1, #3 202.

FIG. 9 illustrates a different piping configuration than shown in FIG. 8. In this embodiment, an oil separator 209 is disposed in the common supply line 204. The oil separator 209 may include a steel mesh to coalesce the oil entrained in the refrigerant flow. Alternately, a fibrous filter media may be used to separate oil from the flow of refrigerant. As shown in FIG. 9, once the oil has been extracted from the refrigerant by the oil separator 209, the oil is directed to the inlet supply line 208 for the lead compressor #2 202. FIG. 9 illustrates that gravity may be used to facilitate the flow of oil to the lead compressor #2 202. As can be seen from FIG. 9, a relatively lesser amount of oil flows around the oil separator 209 to the inlet supply lines 208 leading to the remaining, non-lead compressors #1, #3 202. As shown, the inlet supply lines 208 to the remaining, non-lead compressors #1, #3 202 include restrictions 211 for reducing the suction pressure at the inlets of the remaining compressors #1, #3 202.

Referring again to FIGS. 6 and 7, each compressor 202 has an opening 210 through its outer housing 12 (see FIGS. 2 and 3) to the oil sump 76 (see FIGS. 2 and 3) for the compressor 202. A pipe 212 is connected to each opening 210 such that all of the oil sumps 76 for compressors #1, #2, and #3 202 are in fluid communication via pipe 212. In a particular embodiment of the invention, each opening 210 is located at approximately the same position on the outer housings 12 of the compressors 202. Each opening 210 may be located at the same horizontal level, or located at a particular sump level such that the position of each opening 210 represents a minimum level of oil that should be retained in the oil sump 76 before that compressor 202 can distribute its oil to other compressors 202. Locating the openings 210 in this manner allows for oil to flow through the pipe 212 from the lead compressor #2 202 to other operating compressors 202 in need of oil.

In the embodiments shown in FIGS. 6 and 7, the common supply line 204 is configured to return more oil from the flow of refrigerant to the lead compressor #2 202. When the oil level in the oil sump 76 of the lead compressor #2 202 rises above the level of the opening 210 and above the level in compressors #1 and #3 202 (assuming these compressors are running), the oil sump pressure in the lead compressor #2 202 tends to be higher than that of compressors #1 and #3 202, thus allowing oil to flow through pipe 212 from the lead compressor #2 202 to the remaining compressors #1 and #3 202.

This flow can take place whether or not the lead compressor #2 202 is running, as long as the oil sump pressure in the lead compressor #2 202 is higher than the oil sump pressure in the receiving compressor 202. In certain embodiments, the oil will continue to be distributed in this manner until the oil sump pressures in the lead compressor #2 202 and the receiving compressor(s) 202 are approximately equal. However, when either or both of the remaining compressors #1 and #3 202 is not running, the increased oil sump pressure in the non-running or non-operating compressor 202 prevents oil from the lead compressor #2 202 from flowing to the non-running compressor 202.

The combination of providing more oil to the lead compressor #2 202 and configuring the piping to create reduced pressure at the suction inlet port 18 in the remaining compressors #1 and #3 202 will result in sufficient oil distribution to all of the compressors #1, #2, and #3 202 in this multiple-compressor arrangement, regardless of whether any individual compressor is on or off. This is shown in the operating matrix below in Table 1.

TABLE 1

| Comp #1 | Sump ΔP | Comp #2 | Sump ΔP | Comp #3 | Description (Running Compressors need oil) |
|---|---|---|---|---|---|
| I | < | I | > | I | #2 receives system oil and feeds #1 & #3 |
| O | > | I | > | I | #2 receives system oil and feeds #3 |
| 1 | < | O | > | I | #2 receives system oil and feeds #1 & #3 |
| 1 | < | I | < | O | #2 receives system oil and feeds #1 |
| O | > | O | > | I | #2 receives system oil and feeds #3 |
| I | < | O | < | O | #2 receives system oil and feeds #1 |
| O | > | I | < | O | #2 receives system oil |

I = ON;
O = OFF

The above-shown matrix (Table 1) indicates how oil is distributed in the refrigeration systems of FIGS. 6 and 7 when the running compressor(s) 202 need oil. As can be seen from the matrix above, when all of the compressors #1, #2, and #3 202 are running, or if the lead compressor #2 202 is off and the remaining compressors #1 and #3 202 are running, the lead compressor #2 202 distributes lubricating oil as needed to the remaining compressors #1 and #3 202. In the case where either, compressor #1 202 is off, or compressor #1 202 and the lead compressor #2 202 are both off, the lead compressor #2 202 provides lubricating oil to the remaining compressor #3 202. Conversely, when compressor #3 202 is off, or when compressor #3 202 and the lead compressor #2 202 are both off, the lead compressor #2 202 provides lubricating oil to the remaining compressor #1 202. Finally, when the lead compressor #2 202 is running, and both remaining compressors #1 and #3 202 are off, the lead compressor #2 202 does not provide any lubricating oil to the remaining compressors #1 and #3 202.

Figure 10:
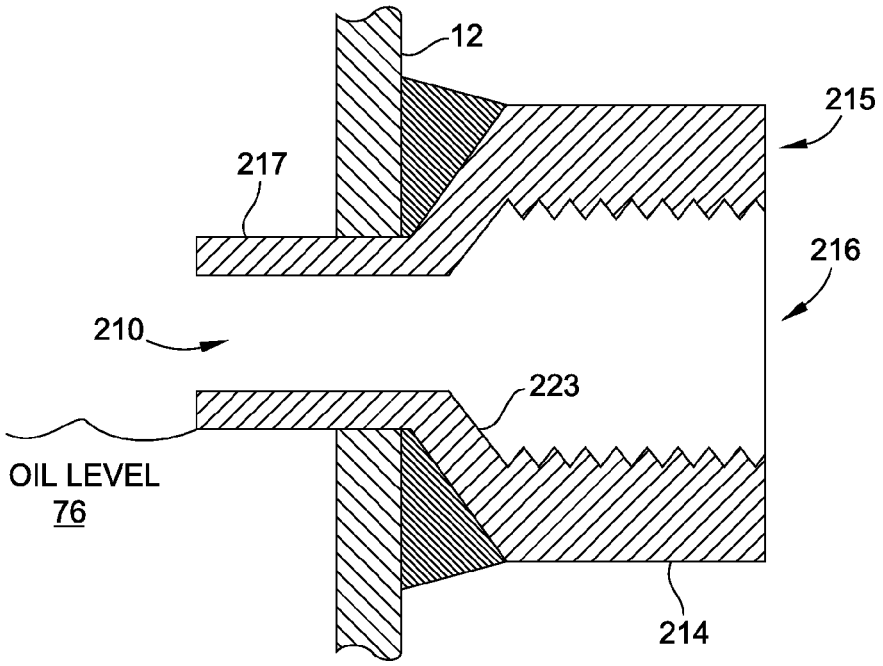
FIG. 10 is a cross-sectional view of a portion of the compressor housing with an attached oil equalization fitting, in accordance with an embodiment of the invention.

FIG. 10 is a cross-sectional view of a portion of the scroll compressor 202 (shown in FIGS. 6 and 7) with an oil equalization fitting 214 (hereinafter "the fitting") inserted into the opening 210 in a sidewall of the outer housing 12 of the scroll compressor 202, in accordance with an embodiment of the invention. Typically, the opening 210 is in the oil sump 76 of the scroll compressor 202 below the inlet port for the compressor to communicate oil to and from the oil sump 76. In certain embodiments, the fitting 214 is welded into the opening 210. However, the fitting 214 may be attached to the outer housing 12 via suitable means other than welding (e.g., threaded into the housing and sealed to prevent leaking) In the embodiment of FIG. 10, the fitting 214 protrudes through the outer housing 12 into an interior portion of the scroll compressor 202. On the exterior of the outer housing 12, (shown in FIGS. 2 and 3) the fitting 214 has a head region 215 for connecting to an oil distribution line made up of pipe 212 (shown in FIGS. 6 and 7). The fitting 214 has a bore 216 therethrough. The bore 216 provides fluid communication between the oil sump of the scroll compressor 202 and the oil distribution line. The section of the bore 216 through the head region 215 may be threaded to facilitate the connection to the oil distribution line. In alternate embodiments, the fitting 214 may be connected to the oil distribution line via brazing.

The fitting includes an extension 217 that projects inwardly toward an internal chamber (i.e., in the interior) of the outer housing 12. The fitting 214 is configured to extend far enough into the interior of the scroll compressor 202 so that oil returned to the scroll compressor 202 that runs down an interior surface of the outer housing 12 will not be drawn into the opening 210, and thus will not interfere with oil equalization. Therefore, oil will only be drawn into opening 210 to flow out of the scroll compressor 202 to the oil distribution line when the oil level reaches the level of the opening 210 in the fitting 214. The fitting 214 may comprise a unitary fitting body with head region 215 and extension 217 formed as a single inseparable unit. The extension 217, which may be tubular, is typically sized to fit somewhat snugly into opening 210, while the head region 215 may be of larger diameter, connected to the extension 217 via a connecting region 223. In alternate embodiments, the fitting 214 may be made from multiple components.

In particular embodiments of the invention, the extension 217 extends inwardly at least 2 millimeters from the interior surface of the outer housing 12. In other embodiments, the extension 217 extends inwardly from the interior surface of the outer housing 12 in a range between 2 and 50 millimeters.

Figure 11:
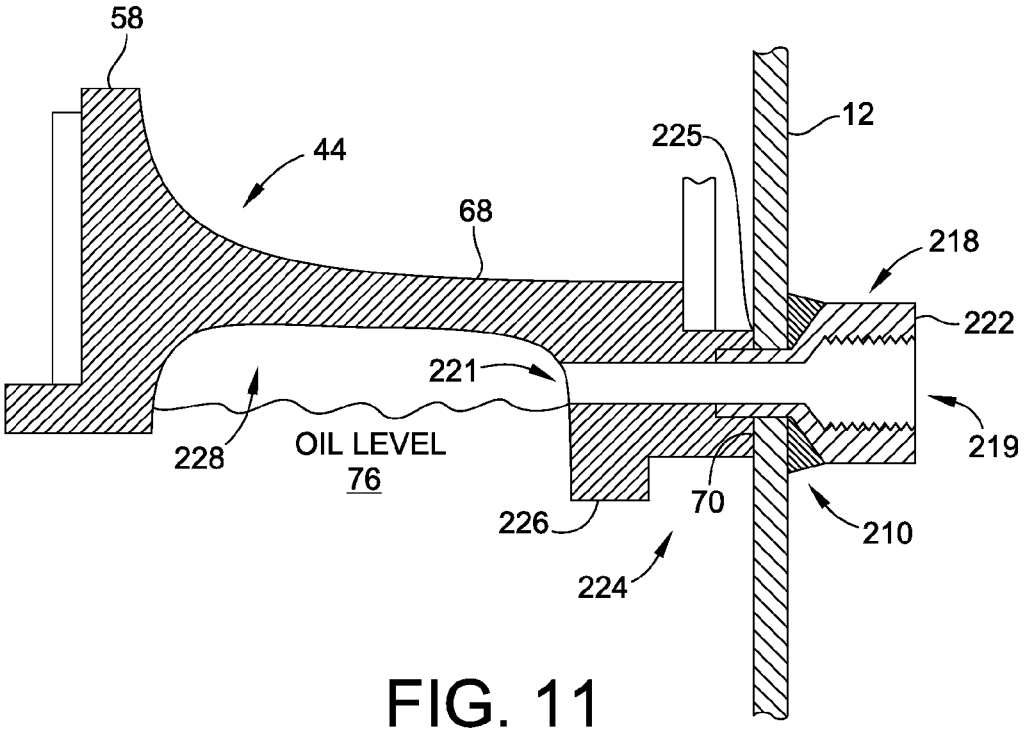
FIG. 11 is a cross-sectional view of a portion of the compressor housing with an attached oil equalization fitting abutting the lower bearing member, in accordance with an embodiment of the invention.

FIG. 11 is a cross-sectional view of a portion of the scroll compressor 202 (shown in FIGS. 6 and 7) with a fitting 218 inserted into the opening 210 in the outer housing 12 (shown in FIGS. 2 and 3) of the scroll compressor 202, in accordance with an alternate embodiment of the invention. The fitting 218 includes a bore 219, and has a head region 222, which may be threaded as in the above-described embodiment, positioned on the exterior of the outer housing 12. Further, the fitting 218 may welded into the opening 210, or connected to the outer housing 12 in another suitable manner (e.g., threaded into the housing and sealed to prevent leaking).

However, the fitting 218 does not protrude as far into the interior of the scroll compressor 202 as does the fitting 214 of FIG. 10. Instead, fitting 218 abuts a peripheral surface of the lower bearing member 44 (shown in FIGS. 2 and 3). The fitting 218 may include an inwardly-projecting extension 225, or may not extend inwardly from the interior surface of the outer housing 12 to the aforementioned abutting position with the lower bearing member 44. Whether or not the fitting 218 includes the inwardly-projecting extension 225, the bore 219 aligns with an opening 221 in the lower bearing member 44 to provide fluid communication between the oil sump of scroll compressor 202 and the oil distribution line made up of pipe 212 (shown in FIGS. 6 and 7). Oil returned to the scroll compressor 202 collects in the oil sump 76 underneath the lower bearing member 44. Oil may be drawn through the opening 221 in the lower bearing member 44 through the fitting 218 to the oil distribution line. However oil running down the interior surface of the outer housing 12 is not drawn into the opening 221 of the lower bearing member 44 or into the bore 219, and thus does not interfere with oil equalization.

In a particular embodiment, and as shown in FIG. 11, the lower bearing member 44 includes central hub 58 (shown in FIG. 2) configured to support the drive shaft 46 (shown in FIGS. 2 and 3), radial extension such as plate-like ledge region 68. The lower bearing member 44 further includes an outer portion, such as axially-extending perimeter surface 70, which may engage with the inner diameter surface of the outer housing 12 to centrally locate the lower bearing member 44. In a more particular embodiment, the outer portion 224 includes a downwardly-depending leg 226. An annular cavity 228 is formed along a bottom side of the radial extension between the central hub 58 and the downwardly-depending leg 226. The oil level in the oil sump 76 may rise into the annular cavity 228 from where it can flow through the opening 221 in the lower bearing member 44 through the bore 219 in the fitting 218 to the oil distribution line to provide oil equalization in the multiple compressors 202.

Figure 13:
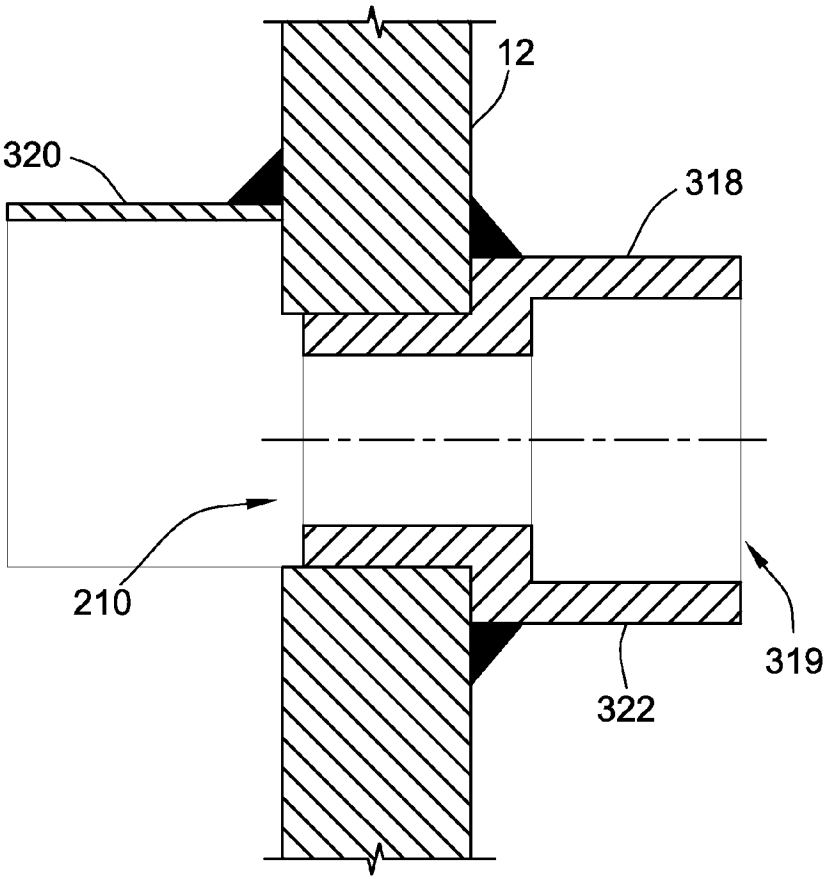
FIG. 13 is a cross-sectional view of a portion of the compressor housing with an attached oil equalization fitting with a deflector attached to an interior wall of the compressor housing, in accordance with an embodiment of the invention.
Figure 12:
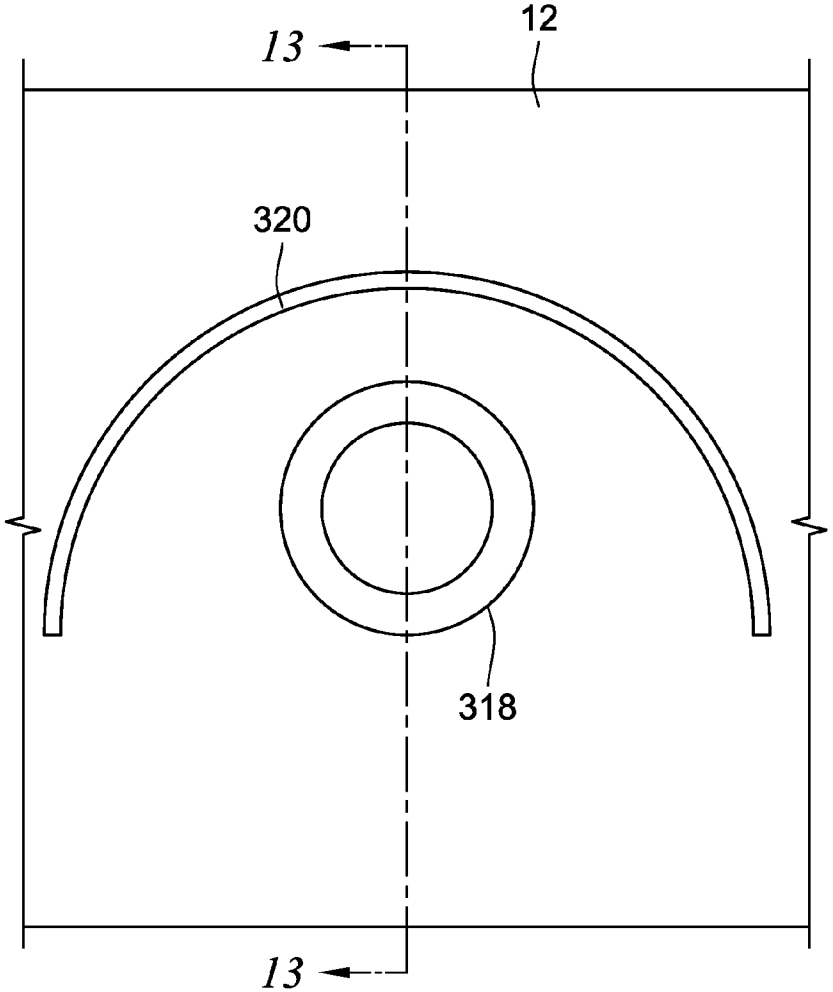
FIG. 12 is a plan view of an interior portion of the compressor housing with an attached oil equalization fitting below a deflector, in accordance with an embodiment of the invention.

An alternate embodiment of the invention is shown in FIGS. 12 and 13. FIG. 12 shows a plan view of an interior portion of the compressor housing 12 with an attached oil equalization fitting 318 below a deflector 320, in accordance with an embodiment of the invention, while FIG. 13 shows a cross-sectional view of a portion of the compressor housing 12 with the attached oil equalization fitting 318 with the deflector 320 attached to an interior wall of the compressor housing 12, in accordance with an embodiment of the invention.

The oil equalization fitting 318 includes a bore 319, and has a head region 322, which may be threaded as in the above-described embodiment, positioned on the exterior of the outer housing 12. Further, the fitting 318 may welded into the opening 210, or connected to the outer housing 12 in another suitable manner (e.g., threaded into the housing and sealed to prevent leaking). The deflector 320 acts to divert oil flowing down the interior wall, or interior surface, of the compressor housing 12 away from the oil equalization fitting 318. In this manner, oil will not flow through the oil equalization fitting 318 until the oil level in the oil sump 76 reaches the opening 210. In the exemplary embodiments shown, the deflector 320 is positioned above the oil equalization fitting 318 and curved to resemble an arch. Thus, downward-flowing oil is directed along the arch-shaped deflector 320 of FIG. 12 to either side of the oil equalization fitting 318. However, the deflector may be a single straight piece instead of curved, and may be angled to direct oil to one side of the oil equalization fitting 318. Alternatively, the deflector 320 could include two angled portions, shaped like an inverted "V" positioned over the oil equalization fitting 318. These and other suitable configurations for the deflector 320 are considered to be within the scope of the claimed invention.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A scroll compressor, comprising:

a housing having an inlet port and an outlet port, the housing having a sidewall with an internal surface surrounding an internal chamber with an oil sump at a bottom of the internal chamber;

scroll compressor bodies in the housing, the scroll compressor bodies having respective bases and respective scroll ribs that project from the respective bases and which mutually engage, the scroll compressor bodies operative to compress fluid entering from the inlet port and discharge compressed fluid toward the outlet port;

a motor providing a rotational output operatively driving one of the scroll compressor bodies to facilitate relative movement for the compression of fluid;

an oil equalization fitting mounted through the sidewall arranged below the inlet port to communicate oil to and from the oil sump, the oil equalization fitting provided with an extension projecting inwardly from the internal surface and into the internal chamber;

wherein the extension extends through an outer portion of a lower bearing member, the lower bearing member supporting a drive shaft driven by the motor to drive the scroll compressor bodies.

2. The scroll compressor of claim 1, wherein the lower bearing member further includes a central hub supporting the drive shaft and at least one radial extension connecting the central hub and the outer portion, the outer portion being mounted and located in contact with the internal surface.

3. The scroll compressor of claim 2, wherein the outer portion includes a leg depending downward from the radial extension, wherein an annular cavity is formed along a bottom side of the radial extension between the central hub and the leg, the extension being formed through the leg and adapted to communicate with oil that extends from the oil sump into the annular cavity.

4. A refrigeration system comprising;

a plurality of compressors connected in parallel with each other;

a common supply line for supplying refrigerant and oil to each of the plurality of compressors;

wherein each of the plurality of compressors has an opening in a lower portion of its compressor housing, each opening configured to accommodate a flow of oil to and from an oil sump for its respective compressor; and wherein at least one of the plurality of compressors has a fitting inserted into its opening, the fitting protruding into an interior space of the at least one compressor;

wherein the plurality of compressors includes a lead compressor and one or more remaining compressors, and wherein the common supply line is configured to return more oil to the lead compressor than to the one or more remaining compressors; and wherein the fitting has an opening aligned with an opening in a lower bearing member of the lead compressor.

5. The refrigeration system of claim 4, wherein the opening in the fitting is arranged to accommodate a flow of oil from the oil sump to an oil distribution line.

* * * * *